US005864930A

United States Patent [19]

Jourde et al.

[11] Patent Number: 5,864,930

[45] Date of Patent: Feb. 2, 1999

[54] NEEDLING MACHINE WITH SLIDING ROD

[75] Inventors: Bernard Jourde, Elbeuf; François Louis, La Saussaye, both of France

[73] Assignee: Asselin, Elbeuf, France

[21] Appl. No.: 849,857

[22] PCT Filed: Dec. 7, 1995

[86] PCT No.: PCT/FR95/01619

§ 371 Date: Jul. 16, 1997

§ 102(e) Date: Jul. 16, 1997

[87] PCT Pub. No.: WO96/17988

PCT Pub. Date: Jun. 13, 1996

[30] Foreign Application Priority Data

Dec. 8, 1994 [FR] France ..... 94 14759

[51] Int. Cl.[6] ..... D04H 18/00

[52] U.S. Cl. ..... 28/107

[58] Field of Search ..... 28/107, 108, 109, 28/110, 111, 112, 113, 114, 115

[56] References Cited

U.S. PATENT DOCUMENTS 4,884,324 12/1989 Stanislaw ..... 28/107

5,511,294 4/1996 Fehrer ..... 28/107

5,528,805 6/1996 Leuchtenmüller ..... 28/115

*Primary Examiner*—C. D. Crowder

*Assistant Examiner*—Larry D. Worrell, Jr.

*Attorney, Agent, or Firm*—Greer, Burns & Crain, Ltd.

[57] ABSTRACT

A needle loom including a support and a stripper defining a path for a fiber lap. A needle board supported by sliding shanks moves back and forth between a maximum penetration position and a retracted position, by means of a connecting rod/crank assembly including a connecting rod hingedly connected to the sliding shank. The shank is guided by slide bearings secured to a mounting which is angularly adjustable about the shank axis so that the axis of ovality can be moved periodically relative to the main direction in which lateral stress is exerted on the bearings as a result of the angular displacement of the connecting rod. The service life of the bearings may thus be extended, while reducing maintenance requirements.

11 Claims, 1 Drawing Sheet

NEEDLING MACHINE WITH SLIDING ROD

BACKGROUND OF THE INVENTION

The present invention relates to a needling machine used for the mechanical consolidation of a sheet -or fleece- of fibres coming, for example, from a spreading and fleecing machine (so-called "cross-lapper").

Known needling machines comprise a support called a board on which needles are fixed. By means of crank and connecting rod devices, the board is moved in an alternating -i.e. reciprocating- manner in order that these needles traverse the sheet of fibres at a production rate which can range from 1000 to 2000 strikes per minute.

Complementary devices also make it possible to regulate the flow of fibres entering and leaving the machine, with or without stretch, and at speeds chosen according to the strike rate expressed as a number of strikes per minute, which is equivalent to the number of alternating movements of the needles per minute.

Conventionally, the connecting rod of each crank and connecting rod device extends between an eccentric, connected to a motor, and an articulation at the end of a sliding rod to which is fixed a needle board support. In order that it may slide, the sliding rod extends through two slide bearings located at a certain distance from one another.

This arrangement has the disadvantage that the bearings are heavily radially loaded in a direction which is always the same, namely the direction of the lateral reaction force which appears between the connecting rod and the sliding rod because of the angle formed between them, taking account of the angular stroke performed by the connecting rod about its axis of articulation with the sliding rod. In particular, it is the bearing closest to the articulation which is the most heavily loaded, typically by five to ten times more than the other one. These bearings are subject to their maximum load, with a jamming tendency which becomes greater as the inclination of the connection rod becomes greater, when the connecting rod pushes the sliding rod in order to make the needles penetrate into the fibrous products. Furthermore, in certain cases, the tension forces in the non-woven product are transmitted to the needles when the latter are engaged into the product. These forces on the needles can also induce lateral forces on the bearings by the intermediary of the needle board support. The result of this is that the bearings wear by becoming oval, which introduces a very harmful play in the guidance of the needle board. The replacement of these bearings requires a relatively long dismantling whilst the machine is immobilized.

The purpose of the present invention is therefore to propose a needling machine in which the problem of wear in the slide bearings is considerably lessened.

BRIEF SUMMARY OF THE INVENTION

According to a first aspect of the invention, the needling machine for mechanically consolidating a sheet of fibres comprising, a casing means of causing the sheet of fibres to progress, a mobile system comprising a needle board support and at least one rod mounted such that it slides in a transverse direction with respect to the sheet in at least one slide bearing, for each sliding rod, a connecting rod having a first end articulated with a drive crank and a second end connected to the sliding rod by an articulation, in order to transmit a reciprocating motion to the support, is characterized in that the bearing is angularly adjustable about the axis of the sliding rod with respect to the casing of the needling machine. When the adjustable bearing or bearings are worn along an axis of ovalization, it suffices to rotate it or them through a fraction of a turn in order that the diametral play due to the wear is thereafter angularly shifted with respect to the direction of the dangerous radial forces, that is to say in general with respect to the plane of oscillation of the connecting rod. It is thus possible to extend the service life of the bearings, it being understood that the adjustment according to the invention can be carried out whilst immobilizing the machine for a brief period only and without it being necessary for personnel from outside the using company to intervene. It is advantageous if both of the bearings are connected to rotate together about the axis of the sliding rod and thus receive each positional adjustment about this axis simultaneously.

Other features and advantages of the invention will emerge from the following description relating to a non-limitative example.

DETAILED DESCRIPTION OF THE INVENTION

Figure 1:
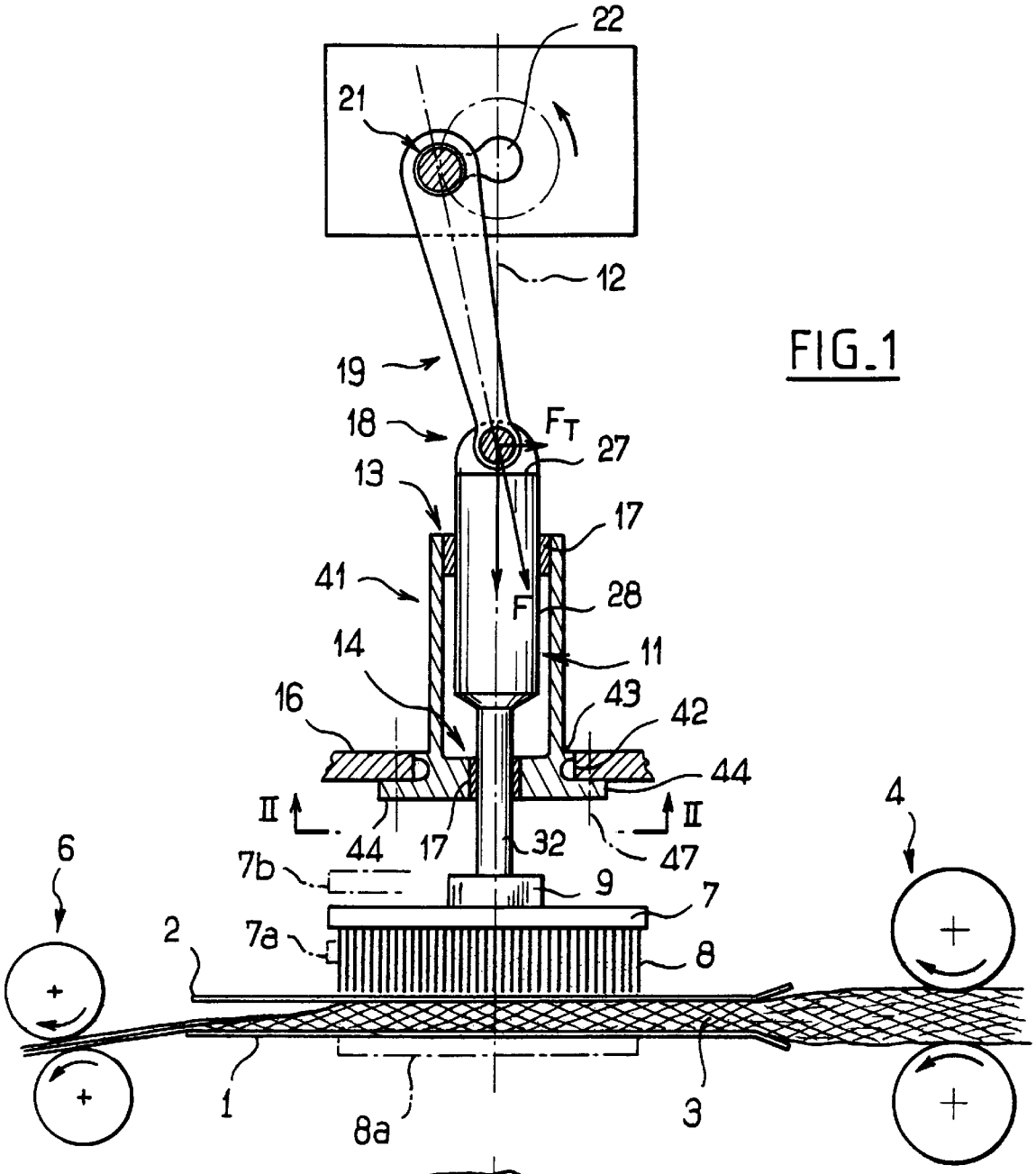
FIG. 1 is a diagrammatic view in elevation, with a partial cross-section, of a needling machine according to the invention.

The needling machine shown in FIG. 1 comprises a generally horizontal perforated table 1 and a retaining plate 2, also called a "stripper", placed approximately parallel to and at a certain distance above the table 1. The table 1 and the stripper 2 between them define a path in an approximately horizontal plane for a sheet of fibres 3. The stripper 2 comprises perforations aligned with those of the table 1. At the entrance of the path there are placed insertion means 4 which are shown in the form of a pair of drive rollers between which the sheet 3 passes. At the exit of the path, the sheet 3, consolidated and compacted by needling, is driven by extraction means 6, also represented by two drive rollers between which the sheet passes.

The stripper 2 is placed between the path of the sheet 3 and a needle board 7. The board 7 carries, on the side facing the stripper 2, a large number of needles 8 oriented perpendicularly to the plane of the path of the sheet 3, with their points facing towards the sheet 3. Each needle is positioned opposite a perforation of the stripper 2 and a corresponding perforation of the table 1. The needle board 7 is fixed, on the side opposite to that of the needles 8, to a support 9 which is itself fixed to the end of at least one rod 11 mounted such that it slides along an axis 12 parallel with the needles 8 and perpendicular to the plane of the path of the sheet 3. If several rods 11 are provided, they are for example aligned one behind the other when seen as shown in FIG. 1. For its sliding guidance, each sliding rod 11 is guided in two coaxial slide bearings 13 and 14 spaced along the axis. The bearings 13 and 14 are rendered integral, by means which will be described below, with a casing 16 which is shown only partially. The bearings 13 and 14 comprise anti-friction bushes 17 for contact with the rod 11.

The mobile system consisting of the sliding rod or rods 11, the support 9 and the board 7 is driven in service with an alternating forward-and-backward (-i.e. reciprocating-) motion in the direction 12 between a position 7*a* in which the ends of the needles, indicated in this case by 8*a,* traverse the stripper 2, the sheet 3 and the table 1, and a separated position 7*b* in which the needles 8 are totally withdrawn at least from the table 1 and the sheet 3, and possibly from the stripper 2.

In order to impart this forward-and-backward motion to the mobile system, the rod 11 is articulated by an articulation 18 to one end of a connecting rod 19 whose other end is connected by an articulation 21 to a crank 22 driven in rotation by driving means which are not shown.

According to the invention, the two bearings 13, 14 are rendered integral with one another by being formed on a common tubular mount 41 which is coaxial with the sliding rod 11 and which can be adjusted angularly about the axis 12 of the sliding rod 11 with respect to the casing 16. The anti-friction bushes 17 are fixed in the mount 41.

The casing 16 has, through a lower wall facing the support 9, a circular orifice 42 centred on the axis 12. The mount 41 is fitted through the orifice 42 and has a collar 43 for centring in the orifice 42. On the outside of the casing 16, the mount 41 is terminated by a flange 44 comprising for example six fixing holes 46 regularly and angularly distributed about the axis 12, intended to receive clamping means 47 such as bolts, engaging in corresponding holes in the casing 16. Thus, in order to adjust angularly the mount 41, together with the bushes 17 which are prone to wear, about the axis 12, the clamping means 47 are taken off, the mount is rotated through an angle of for example 60°, which is equivalent to a whole number (i.e. not a fractionnal number) of times the succession pitch of the clamping means 47 around the axis 12, and the clamping means are then mounted again.

Figure 2:
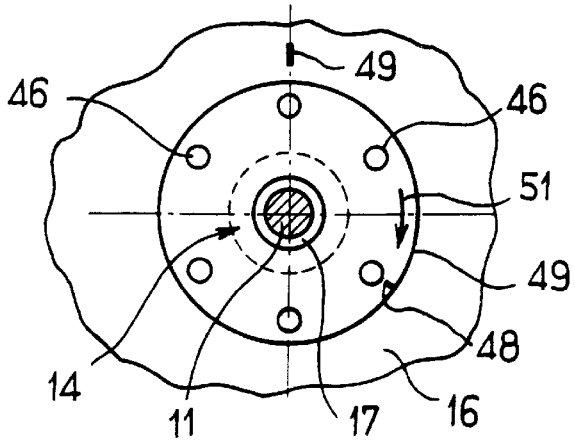
FIG. 2 is a view through II—II of FIG. 1.

There are provided, on the casing 16 and on the flange 44, marks 48 and 49 respectively which are aligned with one another when the machine is brand new but which, as shown in FIG. 2 by way of example, are then angularly shifted by the successive angular adjustments carried out on the mount 41. An arrow 51 also shows the direction of rotation recommended for making the adjustments in order that it is known, starting from a given adjustment, which direction to choose in order not to return to a position which has already been used.

In the example shown, the sliding rod 11 comprises, starting from its end 27 facing the connecting rod 19, a first region 28 having a cylindrical outer surface which is engaged in a sliding manner in the one of the bearings 13 and 14 which is closest to the crank 22.

The sliding rod 11 furthermore comprises a second region 32 which has a smaller diameter than the first region 28. The cylindrical outer surface of the second region 32 slides in the bearing 14 which is closest to the needle board 7 and which has a smaller diameter than the bearing 13.

The bearing 13, which in service is the most loaded one, has a considerably increased diameter which makes it particularly resistant to wear.

In service, the force F transmitted by the connecting rod 19 when it is inclined with respect to the sliding rod 11 has a transverse component $F_T$ which tends to ovalize the bearings 13 and 14 along a diameter parallel to the plane of the angular stroke of the connecting rod 19. When this ovalization reaches an excessive degree, the mount 41 is adjusted angularly with respect to the casing 16, as described above, so that the force $F_T$ is thereafter applied on the bearings 13 and 14 along diameters of the latter which have not yet been increased by the ovalization phenomenon.

The invention is not of course limited to the example described and shown.

The sliding rod 11 could be made with the same diameter over the whole of its length. The two bearings could be adjustable independently from one another. It would also be possible for just one of the bearings, for example the bearing 13 which is the most highly stressed one, to be adjustable.

Instead of anti-friction bushes, it would be possible to form each bearing by means of a bore having appropriate surface treatment, for example a bore produced directly in the material of a pivoting mount otherwise corresponding to the mount 41.

There could be several casings disposed side by side, particularly for machines having a large working width.

The invention is applicable to all types of needling machine, in particular to needling machines with a perforated table such as described, but also to needling machines for manufacturing velvet, terry, etcetra.

We claim:

1. A needling machine for mechanically consolidating a sheet of fibers comprising, a casing, means for causing the sheet of fibers to progress, a mobile system comprising a needle board support and at least one sliding rod mounted in at least one slide bearing for translational motion in a transverse direction with respect to said sheet, for each sliding rod, a connecting rod having a first end articulated with a drive crank and a second end connected to the sliding rod by an articulation, in order to transmit a reciprocating motion to the support, wherein the slide bearing is angularly adjustable about a longitudinal axis of the sliding rod with respect to the casing.

2. A needling machine according to claim 1, characterized in that the adjustability of the slide bearing is achieved by adjustment means which provide for adjustment in angular steps.

3. A needling machine according to claim 1, characterized in that the adjustable slide bearing is fixed to the casing by a series of fixing means regularly and angularly distributed around the longitudinal axis of the sliding rod, the adjustment being made by dismantling the fixing means and repositioning the latter after rotation of the bearing through an angle corresponding to a whole number of times the succession pitch of the fixing means around the longitudinal axis.

4. A needling machine according to claim 1, characterized by means for marking the angular position of the slide bearing with respect to the casing.

5. A needling machine according to claim 1, characterized in that the sliding rod is guided by two axially spaced slide bearings which are attached to one another for common rotation about the longitudinal axis of the sliding rod.

6. A needling machine according to claim 5, characterized in that the sliding rod comprises a first region having a relatively large outer diameter, sliding through the first of the slide bearings, located nearer the crank and having a corresponding relatively large diameter, the sliding rod having a smaller diameter in a second region sliding in the other bearing, having a corresponding smaller diameter, and located nearer the needle board support.

7. A needling machine according to claim 5, characterized in that the bearings are carried by a common tubular mount.

8. A needling machine according to claim 7, characterized in that the tubular mount supports one bush for each bearing.

9. A needling machine according to claim 2, characterized in that the adjustable slide bearing is fixed to the casing by a series of fixing means regularly and angularly distributed around the longitudinal axis of the sliding rod, the adjustment being made by dismantling the fixing means and repositioning the latter after rotation of the bearing through an angle corresponding to a whole number of times the succession pitch of the fixing means around the axis.

10. A needling machine according to claim 6, characterized in that the slide bearings are carried by a common tubular mount.

11. A needling machine according to claim 1, characterized in that the adjustable slide bearing is fixed to the casing by means for fixing regularly and angularly distributed around the longitudinal axis of the sliding rod, the adjustment being made by dismantling the means for fixing and repositioning the latter after rotation of the bearing through an angle corresponding to a whole number of times the succession pitch of the means for fixing around the longitudinal axis.

* * * * *